US011874094B2

(12) United States Patent
Soyturk

(10) Patent No.: US 11,874,094 B2
(45) Date of Patent: Jan. 16, 2024

(54) LASER-BASED FIREARM AND TARGET ASSEMBLY AND METHOD OF USE

(71) Applicant: Naki U. Soyturk, Miami, FL (US)

(72) Inventor: Naki U. Soyturk, Miami, FL (US)

( * ) Notice: Subject to any disclaimer, the term of this patent is extended or adjusted under 35 U.S.C. 154(b) by 0 days.

(21) Appl. No.: 17/925,390

(22) PCT Filed: Mar. 4, 2022

(86) PCT No.: PCT/US2022/018947

§ 371 (c)(1),
(2) Date: Nov. 15, 2022

(65) Prior Publication Data

US 2023/0280133 A1 Sep. 7, 2023

(51) Int. Cl.
*F41A 33/02* (2006.01)
*F41G 3/26* (2006.01)

(52) U.S. Cl.
CPC ..... *F41G 3/2622* (2013.01); *F41A 33/02* (2013.01)

(58) Field of Classification Search
CPC ..... F41A 3/26; F41A 3/2616; F41A 3/2622; F41A 3/2644; F41A 3/2655; F41A 33/00; F41A 33/02
See application file for complete search history.

(56) References Cited

U.S. PATENT DOCUMENTS 5,947,477 A 9/1999 Turnipseed
5,947,738 A * 9/1999 Muehle ..... F41A 33/02 434/18
6,146,141 A * 11/2000 Schumann ..... F41A 33/02 434/21
10,788,289 B1 * 9/2020 Wallace ..... F41J 5/10
2002/0009694 A1 * 1/2002 Rosa ..... F41A 33/02 434/16
2002/0197584 A1 12/2002 Kendir et al.
2007/0190495 A1 * 8/2007 Kendir ..... F41A 33/02 434/21
2010/0221685 A1 * 9/2010 Carter ..... F41A 33/00 434/19
2011/0275435 A1 * 11/2011 Torre ..... A63F 13/245 463/37

(Continued)

FOREIGN PATENT DOCUMENTS

DE 4005940 A1 8/1991

*Primary Examiner* — Kurt Fernstrom
(74) *Attorney, Agent, or Firm* — Mark C. Johnson; Johnson Dalal

(57) ABSTRACT

A laser-based firearm and target training assembly that includes a handheld target structure of a material configured to generate a visually perceivable indicia when subjected to a laser light with a frequency range of 220-1060 nm and a handheld firearm assembly with a body having a barrel portion defining a muzzle, defining an internal laser housing channel, and including an upper surface. The assembly also includes a laser emission module disposed within the internal laser housing channel, with an emission aperture facing and aligned with the muzzle, and operably configured to emit a pulsed laser light emission of a frequency range of 220-1060 nm from the emission aperture when a user pulls a trigger thereon that causes an electronic controller to have the laser emission module emit the pulsed laser light emission therefrom to generate the visually perceivable indicia on the target structure.

17 Claims, 8 Drawing Sheets

(56) References Cited

U.S. PATENT DOCUMENTS

| | | | | |
|---|---|---|---|---|
| 2012/0129136 | A1* | 5/2012 | Dvorak | F41A 33/06 434/18 |
| 2013/0122471 | A1* | 5/2013 | Yach | F41J 5/02 434/22 |
| 2013/0316308 | A1* | 11/2013 | Monti | H02K 41/031 434/16 |
| 2013/0319216 | A1* | 12/2013 | Poirier | F41A 21/32 42/114 |
| 2017/0261283 | A1* | 9/2017 | Crouch | F41G 3/2611 |
| 2018/0372440 | A1* | 12/2018 | Armstrong | F41G 3/2655 |
| 2020/0088489 | A1 | 3/2020 | Dottle | |
| 2020/0166306 | A1* | 5/2020 | Uhr | F41A 33/02 |
| 2021/0199408 | A1* | 7/2021 | Reed | G06N 3/08 |

* cited by examiner

LASER-BASED FIREARM AND TARGET ASSEMBLY AND METHOD OF USE

FIELD OF THE INVENTION

The present invention relates laser-based firearms and training systems and methods and, more particularly, relates to laser-based firearms operably configured to create visually perceivable indicia on one or more targets utilized therewith.

BACKGROUND OF THE INVENTION

Many users throughout the world desire to utilize firearms for personal protection, sport, hunting, and other means. To that end, many users desire to practice and train firing their firearm for increasing their comfort and aim associated with said firearm. To practice and train with their firearm, users typically have to go to a gun range or other protected area to fire the firearm, which can often be expensive, messy, time-consuming, and, in some instances, unsafe.

Some known alternative firearms do not utilize bullets or other ammunition that could be lethal or expensive. However, many of these alternative firearms do not efficiently or effectively emulate the weight, handling, or use of a conventional firearm. For example, a laser-based firearm may not utilize a clip(s)/magazine(s), a sight(s), a grip, or other structure conventionally utilized with a firearm. Furthermore, these alternative firearms are often unable or impracticable to use in some locations, e.g., a user's home. Therefore, a need exists to overcome the problems with the prior art as discussed above.

SUMMARY OF THE INVENTION

The invention provides a laser-based firearm and target training assembly or kit that overcomes the hereinaforementioned disadvantages of the heretofore-known devices and methods of this general type and that enables users to emulate use of a conventional firearm, e.g., semi-automatic rifle, AR15, handgun, etc., in a safe, effective, and efficient manner.

With the foregoing and other objects in view, there is provided, in accordance with the invention, a laser-based firearm and target training assembly that includes a handheld target structure of a material configured to generate a visually perceivable indicia when subjected to a laser light with a frequency range of 220-1060 nm and a handheld firearm assembly that includes a body with a grip portion and with a barrel portion defining a muzzle, defining an internal laser housing channel, and including an upper surface. The firearm assembly also includes a laser emission module disposed within the internal laser housing channel, with an emission aperture facing and aligned with the muzzle, and operably configured to emit a pulsed laser light emission of a frequency range of 220-1060 nm from the emission aperture and includes a trigger translatably coupled to the body and having a firing position along a trigger translation path and a static position along the trigger translation. The firearm assembly also includes a battery power source electrically coupled to the laser emission module and coupled to the body and an electronic controller electrically coupled to the battery power source, operably coupled to the laser emission module and the trigger, and operably configured to cause the laser emission module to emit the pulsed laser light emission through the emission aperture and the muzzle when the trigger is in the firing position and cease emission of the pulsed laser light emission when the trigger is in the static position.

In accordance with another feature, an embodiment of the present invention includes the handheld target structure of a paper-based material configured to generate a visually perceivable indicia when subjected to a laser light with a frequency range of 220-380 nm and the laser emission module that is operably configured to emit the pulsed laser light emission of a frequency range of 220-380 nm from the emission aperture.

In accordance with yet another feature, an embodiment of the present invention also includes a firing type toggle switch projecting through an aperture defined on the body operably coupled with the electronic controller, wherein the firing type toggle switch is operably configured to include a semi-automatic position and an automatic position along a type switch translation path. The semi-automatic position is operably configured to cause a single pulsed laser light emission when the trigger is in the firing position and the automatic position operably configured to cause a frequency of pulsed laser light emissions when the trigger is in the firing position, thereby simulating a conventional automatic or semi-automatic firearm.

In accordance with a further feature, an embodiment of the present invention also includes the body defining an internal magazine housing and a magazine body selectively removably coupled to the body and disposed within the internal magazine housing, wherein one of the plurality of positions along the type switch translation path generates, through the electronic controller, a defined frequency limit of the pulsed laser light emission and the electronic controller operably configured to cause the laser emission module to emit the pulsed laser light emission through the emission aperture and the muzzle when the trigger is in the firing position and when the magazine body is selectively removably coupled to the body.

In accordance with an additional feature, an embodiment of the present invention also includes a magazine sensor coupled to the body and operably configured to detect when the magazine body is selectively removably coupled to the body and a magazine release switch projecting through an aperture defined on the body and operably configured to lock and engage with the magazine body and unlock and disengage with the magazine body.

In accordance with yet another feature, an embodiment of the present invention also includes the firing type toggle switch operably configured to have a magazine position along the type switch translation path, wherein the magazine position is operably configured to generate an original limited and diminishable amount of laser light emissions operably configured to be emitted from the laser emission module when the trigger is in the firing position (like a conventional firearm utilizing a magazine). Further, the assembly may include a memory coupled to the body, communicatively coupled to the electronic controller, and having computer-readable instructions resident thereon and programed to determine the amount of laser light emissions operably configured to be emitted from the laser emission module when the trigger is in the firing position, cease laser light emissions operably configured to be emitted from the laser emission module when the trigger is in the firing position and when the amount of laser light emissions has diminished to a numeral value of zero, and reset to the original limited and diminishable amount of laser light emissions operably configured to be emitted from the laser emission module when the trigger is in the firing position when the magazine sensor detects when the magazine body is selectively removably coupled to the body.

In accordance with a further feature of the present invention, the magazine body has a weight ranging from 12 oz-1 lb12 oz.

In accordance with another feature, an embodiment of the present invention also includes the body having a slide member translatably coupled to the body, defining at least a portion of the barrel portion, defining the upper surface of the barrel portion, and operably configured to have a static position and a dynamic position along a slide translation path and a slide sensor operably configured to detect when the slide member is in the dynamic position, wherein the memory includes computer-readable instructions resident thereon and programed to prevent the laser emission module from emitting the pulsed laser light emission through the emission aperture and the muzzle when the trigger is in the firing position until the slide member is detected in the dynamic position.

In accordance with an additional feature, an embodiment of the present invention also includes the body having a bottom surface opposing the upper surface of the barrel portion, a front sight coupled to the upper surface of the barrel portion and disposed proximal to the muzzle, and a rear sight coupled to the upper surface of the barrel portion and aligned with the front sight, wherein the laser emission module is interposed between the bottom surface and the upper surface.

In accordance with an exemplary feature, an embodiment of the present invention also includes the body defining an internal magazine housing and having a magazine body selectively removably coupled to the body and disposed within the internal magazine housing, wherein the electronic controller is configured to generate a defined frequency limit of the pulsed laser light emission and operably configured to cause the laser emission module to emit the pulsed laser light emission through the emission aperture and the muzzle when the trigger is in the firing position and when the magazine body is selectively removably coupled to the body.

In accordance with a further feature, an embodiment of the present invention also includes a magazine sensor coupled to the body and operably configured to detect when the magazine body is selectively removably coupled to the body and a magazine release switch projecting through an aperture defined on the body and operably configured to lock and engage with the magazine body and unlock and disengage with the magazine body.

In accordance with yet another feature, an embodiment of the present invention also includes the electronic controller operably configured to generate an original limited and diminishable amount of laser light emissions operably configured to be emitted from the laser emission module when the trigger is in the firing position and having a memory coupled to the body, communicatively coupled to the electronic controller, and having computer-readable instructions resident thereon and programed to determine the amount of laser light emissions operably configured to be emitted from the laser emission module when the trigger is in the firing position, cease laser light emissions operably configured to be emitted from the laser emission module when the trigger is in the firing position and when the amount of laser light emissions has diminished to a numeral value of zero, and reset to the original limited and diminishable amount of laser light emissions operably configured to be emitted from the laser emission module when the trigger is in the firing position and when the magazine sensor detects when the magazine body is selectively removably coupled to the body.

In accordance with a further feature of the present invention, the internal laser housing is of a shape corresponding to a shape of the laser emission module, wherein the body has two opposing internal walls defining a length separating each other and substantially equal, or within 5% deviance, to a length separating two opposing ends of the laser emission module, the emission aperture of the laser emission module disposed proximal to the muzzle.

In accordance with another feature, an embodiment of the present invention also includes a central muzzle axis spanning through a centroid defined by the muzzle and a central emission axis defined by the pulsed laser light emission operably configured to be emitted from the emission aperture and, when emitted from the emission aperture, substantially aligned with and parallel to the central muzzle axis.

In accordance with a further feature, an embodiment of the present invention also includes a gyroscope communicatively coupled to a memory coupled to the body, wherein the gyroscope is operably configured to detect an orientation of the body and store the orientation of the body on the memory when the trigger is in the firing position.

Also according to the present invention, a method of target training with a laser-based firearm is disclosed that includes providing a handheld target structure of a paper-based material with an outer surface configured to generate a visually perceivable indicia when subjected to a laser light with a frequency range of 220-380 nm and providing a handheld firearm assembly having a body with a grip portion, with a barrel portion defining a muzzle, and defining an internal laser housing channel, having a laser emission module disposed within the internal laser housing channel, with an emission aperture facing and aligned with the muzzle, having a trigger translatably coupled to the body and with a firing position along a trigger translation path and with a static position along the trigger translation, and having a battery power source electrically coupled to the laser emission module and coupled to the body. The method also includes placing the handheld target structure in an upright configuration so the user can see the target structure, aiming the muzzle of the handheld firearm assembly toward the outer surface of the handheld target structure, and placing the trigger in the firing position to emit a pulsed laser light emission with a frequency range of 220-380 nm through the emission aperture and the muzzle to generate the visually perceivable indicia on the outer surface of the handheld target structure. Further, the method includes placing the trigger in the static position to cease emission of the pulsed laser light emission when the trigger is in the static position.

In accordance with yet another feature, an embodiment of the present invention also includes providing the handheld firearm assembly with an electronic controller electrically coupled to the battery power source, and operably coupled to the laser emission module and the trigger, causing the laser emission module to emit the pulsed laser light emission through the emission aperture and the muzzle when placing the trigger in the firing position and causing the laser emission module to cease emission of the pulsed laser light emission when placing the trigger in the static position.

In accordance with an additional feature, an embodiment of the present invention also includes providing the body of the handheld firearm assembly that defines an internal magazine housing and a magazine body selectively removably coupled to the body and disposed within the internal magazine housing and defining, with the electronic controller, a defined frequency limit of the pulsed laser light emission and operably configured to cause the laser emission module to emit the pulsed laser light emission through the emission aperture and the muzzle when placing the trigger in the firing position and when the magazine body is selectively removably coupled to the body.

In accordance with yet another feature, an embodiment of the present invention also includes providing the handheld firearm assembly with the electronic controller that is operably configured to generate an original limited and diminishable amount of laser light emissions operably configured to be emitted from the laser emission module when placing the trigger in the firing position, determining the amount of laser light emissions operably configured to be emitted from the laser emission module when placing the trigger in the firing position, ceasing laser light emissions operably configured to be emitted from the laser emission module when placing the trigger in the firing position and when the amount of laser light emissions has diminished to a numeral value of zero, and resetting to the original limited and diminishable amount of laser light emissions operably configured to be emitted from the laser emission module when placing the trigger in the firing position and when a magazine sensor detects when the magazine body is selectively removably coupled to the body.

Although the invention is illustrated and described herein as embodied in a laser-based firearm and target training assembly and method, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the barrel of the firearm. The terms "program," "software application," and the like as used herein, are defined as a sequence of instructions designed for execution on a computer system. A "program," "computer program," or "software application" may include a subroutine, a function, a procedure, an object method, an object implementation, an executable application, an applet, a servlet, a source code, an object code, a shared library/dynamic load library and/or other sequence of instructions designed for execution on a computer system.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
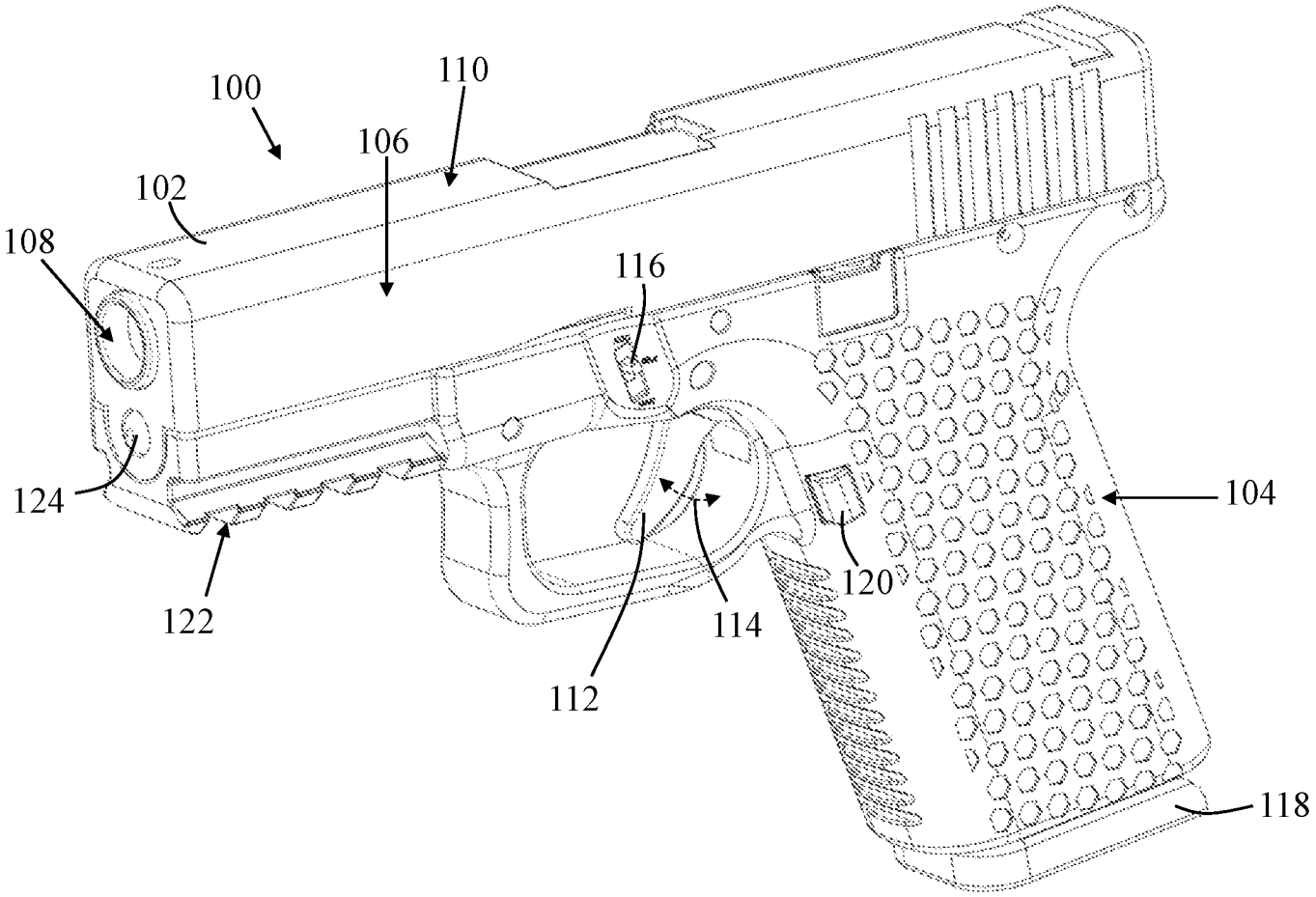
FIG. 1 is a perspective view of a laser-based firearm assembly utilized with a laser-based firearm and target training assembly in accordance with one embodiment of the present invention.
Figure 3:
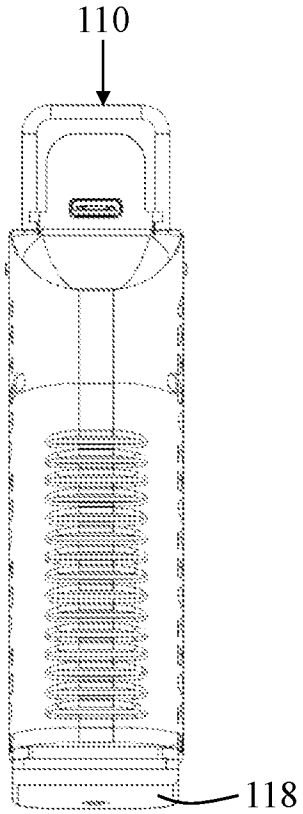
FIG. 3 is an elevational rear view of the laser-based firearm assembly in FIG. 1.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

Figure 7:
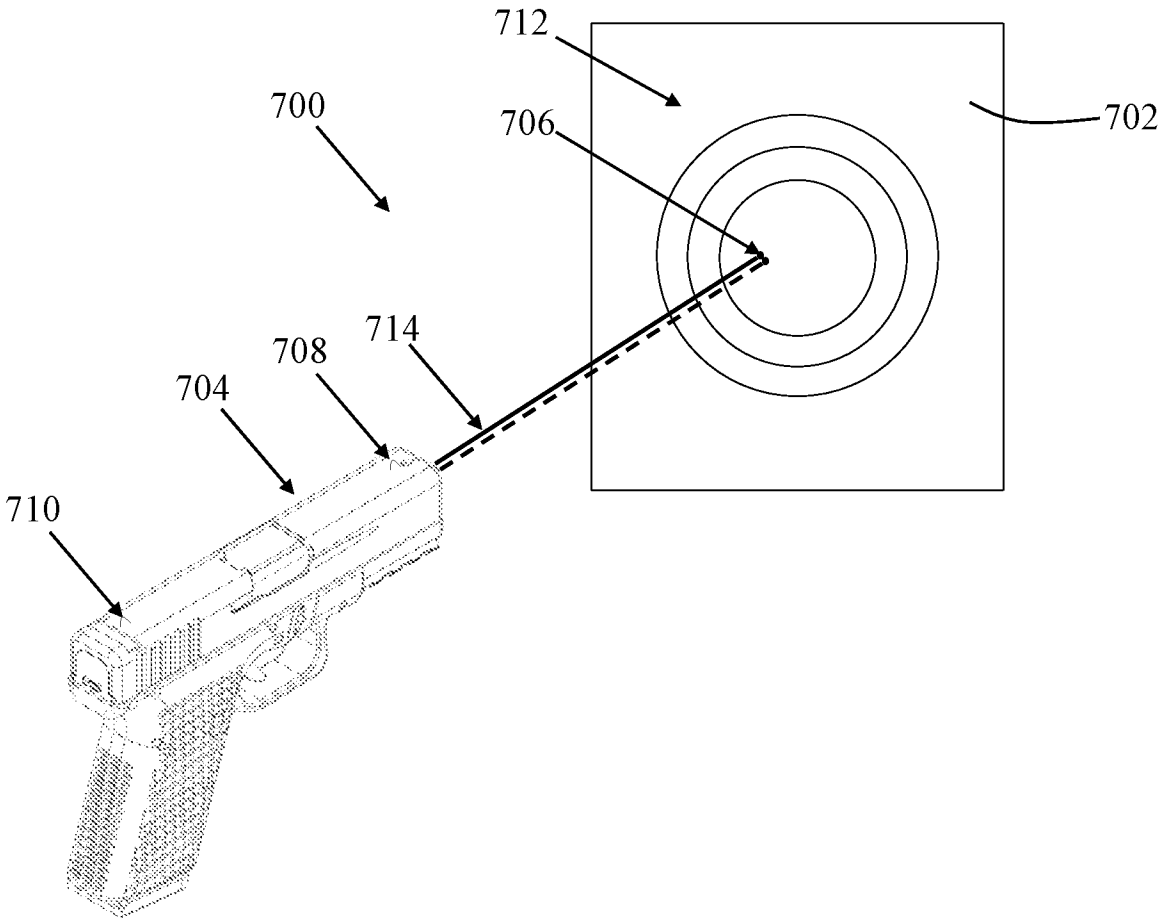
FIG. 7 is a perspective view of a laser-based firearm and target training assembly in accordance with one embodiment of the present invention.

The present invention provides a novel and efficient laser-based firearm and target training assembly that enables effective and efficient use of a firearm for training purposes. Referring now to FIG. 1 and FIG. 7, embodiments of the present invention are shown. More specifically, FIG. 1 shows several advantageous features of the present invention, but, as will be described below, the invention can be provided in several shapes, sizes, combinations of features and components, and varying numbers and functions of the components. The first example of a laser-based firearm and target training assembly 700 includes a handheld firearm assembly 100, 704, as shown in perspective views of FIG. 1 and FIG. 7, and a handheld target structure 702 of a material configured to generate a visually perceivable indicia (e.g., indicia 706) when subjected to a laser light with a frequency range of 220-1060 nm. Said another way, the present invention provides a handheld firearm operably configured to be manipulated and handled by a user in a fashion similar to conventional firearm, but is specially configured to emit a pulsed laser out of the muzzle when fired to cause an indicia (e.g., discoloration, marking, etc.) on the target structure 702 so that user knows where on the target 702 the firearm was shot.

To effectuate carrying out the invention as discussed herein, the handheld firearm assembly 100, 704 may include a body 102 with a grip portion 104 and a barrel portion 106, wherein the body may be of a substantially rigid and durable material, similar to a conventional firearm. In one example, the body may be formed with multiple pieces of material or components to form the body 102 depicted in the figures. In one embodiment, the body 102 is made with a water- or stain-resistant material, such stainless steel, PVC, HDPE etc. The body 102 may be of a monolithic structure and otherwise operating as a unit. The body 102, namely the barrel portion 106, can be seen defining a muzzle 108 that is preferably enclosed and defining an internal laser housing channel 600 shaped and sized to be received a laser emission module 604 operably configured to emit the pulsed laser emission(s) 714 through an emission aperture 606 on the module 604 when the firearm is fired. The internal laser housing channel 600 is spatially coupled to the muzzle 108 and is preferably enclosed by the body 102 or, preferably, a slide member 612 translatably coupled to the body 102.

In one embodiment, the internal laser housing 600 is of a shape corresponding to a shape of the laser emission module 604, e.g., the internal laser housing 600 and laser emission module 604 are cylindrical and of a similar or close diameter to form a retained configuration. In a further embodiment, the body 102 may include two opposing internal walls 604, 606 defining a length separating each other and substantially equal to a length separating two opposing ends 612, 614 of the laser emission module 604, wherein the emission aperture 606 of the laser emission module 604 disposed proximal to the muzzle 108, i.e., at or near, within 10% of the overall length of the laser emission module 604. As used herein, the term "wall" is intended broadly to encompass continuous structures, as well as, separate structures that are coupled together so as to form a substantially continuous external surface.

The body 102, namely the barrel portion 106, also includes an upper surface 110 and a bottom surface 122 opposing the upper surface 110 of the barrel portion 106. It should be understood that terms such as, "front," "rear," "side," "upper," "bottom," and the like are indicated from the reference point of a viewer viewing the firearm body 102 (or other structure) when conventionally held by the user during use. In one embodiment, the assembly 100 includes a front sight 708 coupled to the upper surface 110 of the barrel portion 106 and disposed proximal to the muzzle 108, and further includes a rear sight 710 coupled to the upper surface 110 of the barrel portion 106 and aligned with the front sight 708. The front and rear sights 708, 710 may be made of the same material as the body 102, are preferably located on the slide member 612, and extend a length of approximately less than 0.5 inch to a terminal end thereof. The rear sight 710 is preferably proximal to the rear end of the slide member 612 or body 102 (as seen in the figures). The laser emission module 604 is interposed between the bottom surface 112 and the upper surface 110 to beneficially enable conventional and effective use of sights 708, 710.

Beneficially, the laser emission module 604 is disposed within the internal laser housing channel 600 with the emission aperture 606 facing and aligned with the muzzle 108, and is operably configured to emit a pulsed laser light emission of a frequency range of 220-1060 nm from the emission aperture 606. Said another way, the pulsed laser light emission(s) (best depicted in FIG. 7) are operably configured to be generated by the laser emission module 604 when the trigger 112 is pulled (or translated), like a conventional firearm (e.g., gun). This is strikingly different than other known practice firearms continually emit a laser when trigger is depressed. The laser emission module 604 may consist of housing encapsulating and/or retaining a transmitting device which may include an optics package and a lens for emitting a laser light pulse therefrom.

Figure 6A:
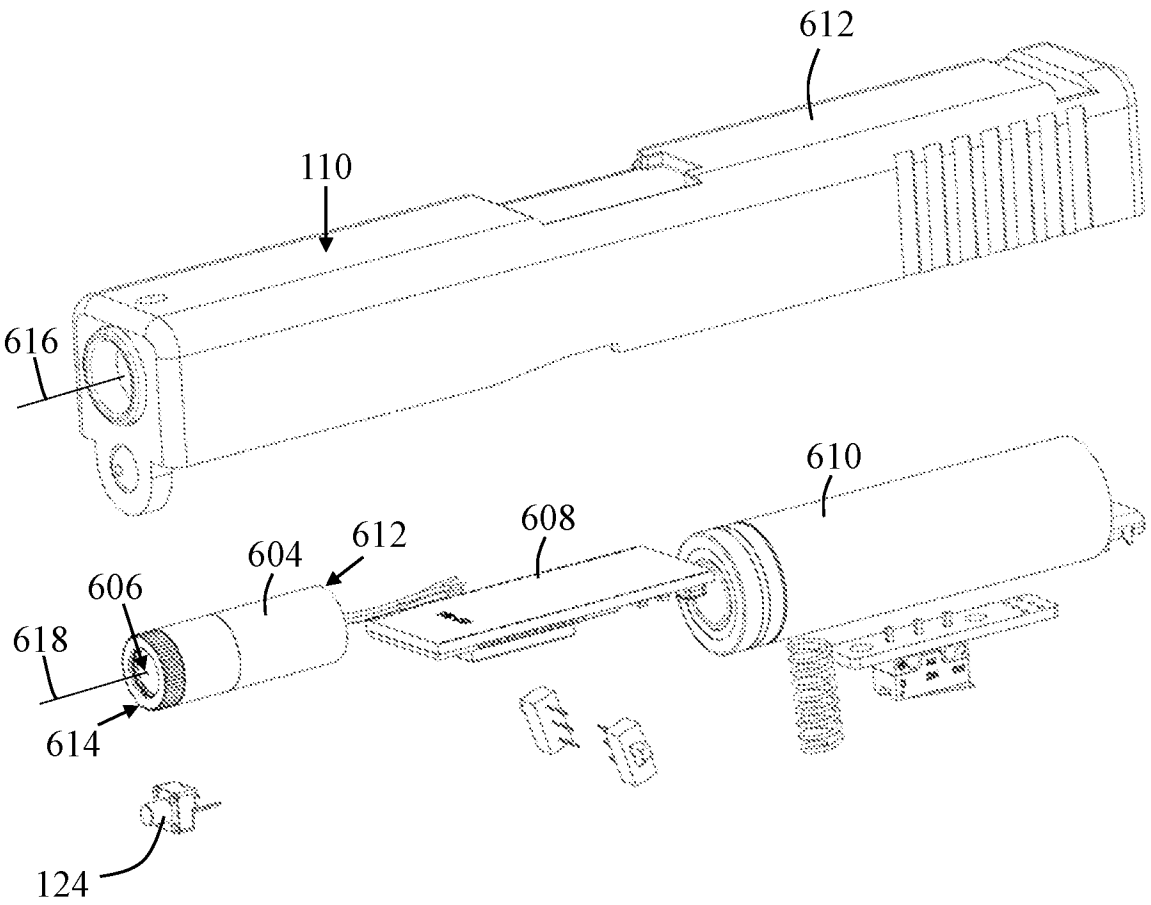
FIGS. 6*a-b* are exploded fragmentary views of the laser-based firearm assembly in FIG. 1.
Figure 6B:
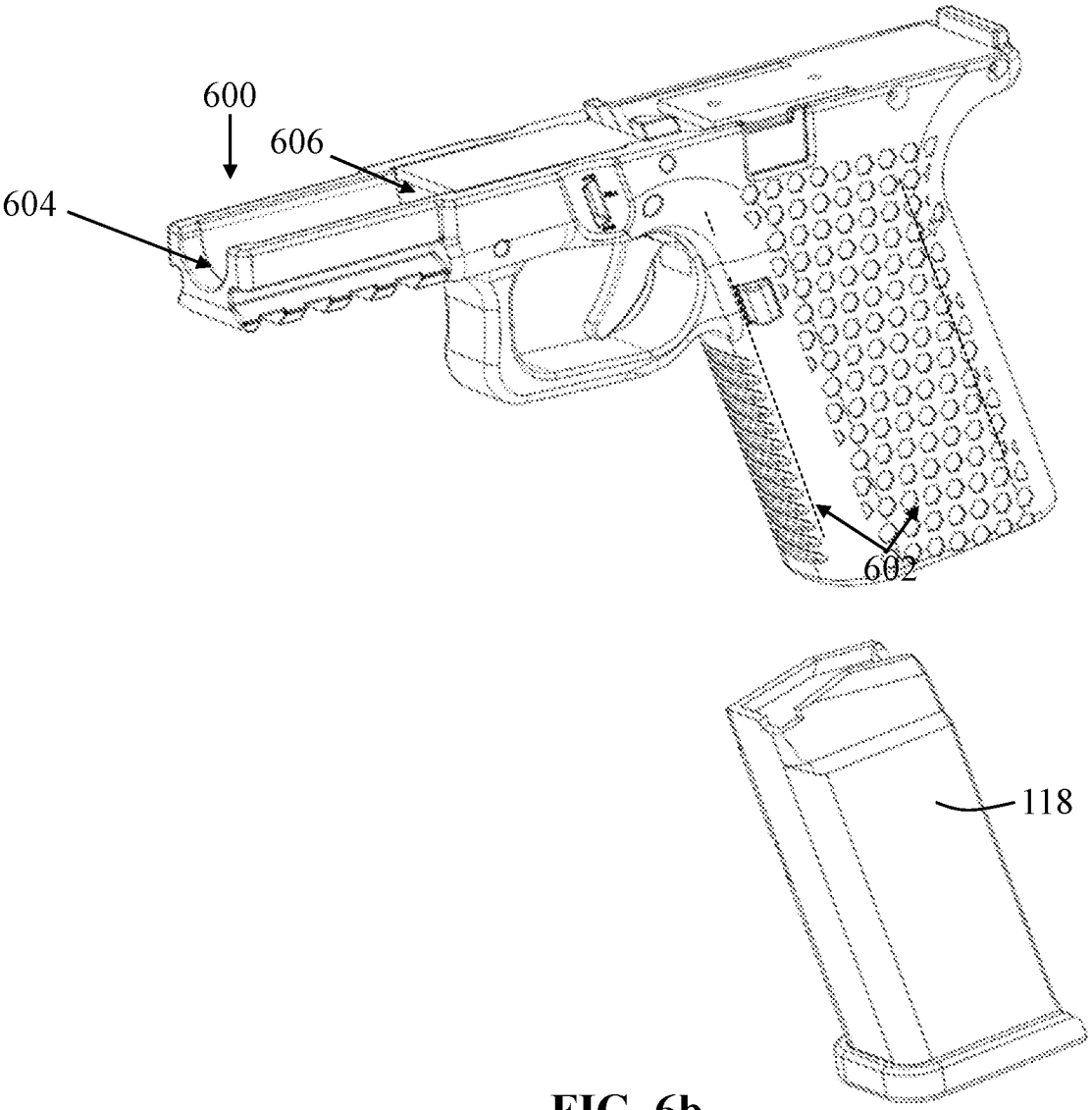
Figure 8:
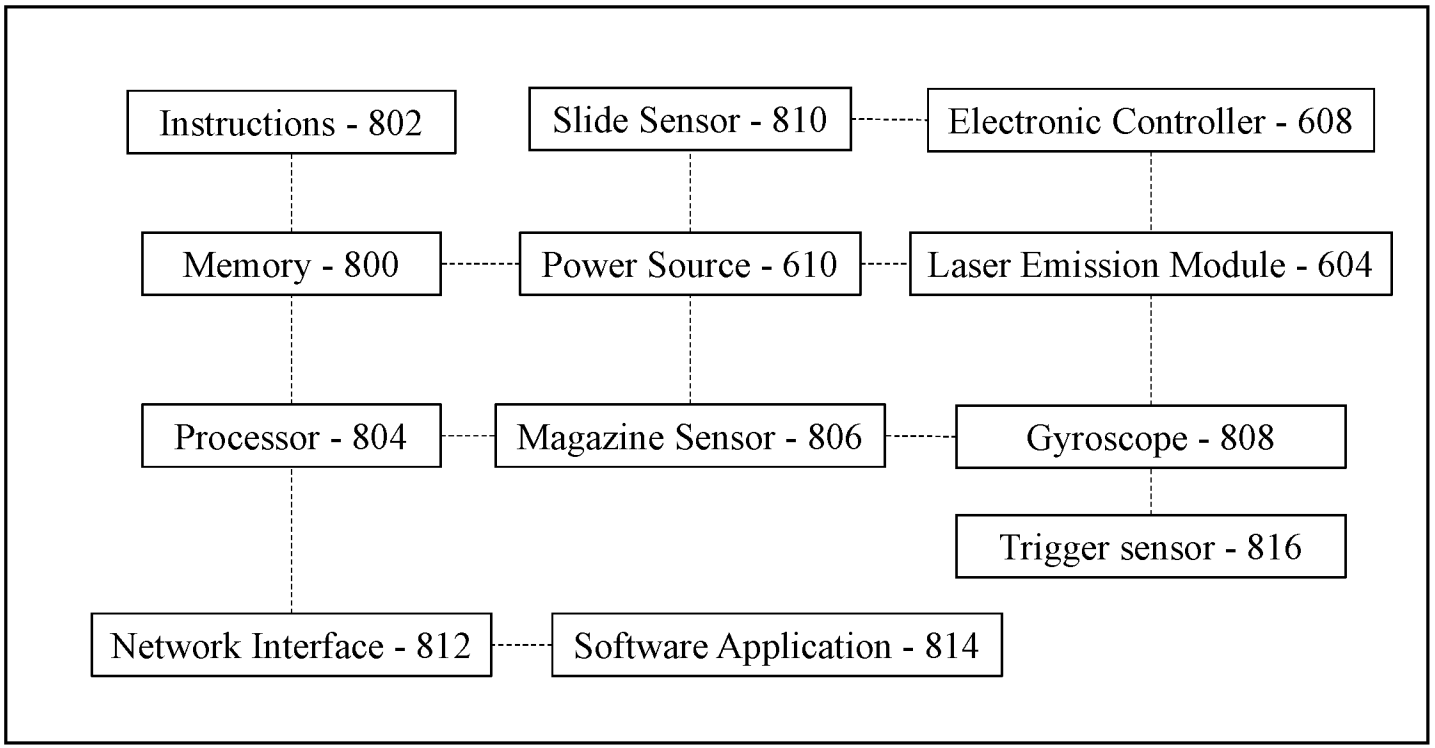
FIG. 8 is a block diagram depicting exemplary components communicatively and/or electrically coupled in the laser-based firearm and target training assembly in accordance with the present invention.

Additionally, the laser emission module 604 may include a local power source or may be electrically coupled to a power source 610 coupled to the body 102 and housed therein (as depicted in FIG. 6*a* and FIG. 8). The laser emission module 604 is operably configured to send out pulsed laser light emission(s) of a short and/or limited pulse width and only with the trigger 112 in a firing position (exemplified in FIG. 7).

Specifically, the trigger 112 is translatably coupled to the body 102, i.e., rotatably, operable to translate linearly, and/or of a curvilinear shape/path. The trigger 112 also includes a firing position along a trigger translation path (exemplified with arrow 114) and a static position (FIG. 1) along the trigger translation 114. The assembly 100 may also beneficially include an electronic controller 608 electrically coupled to the battery power source 610 and operably coupled to the laser emission module 604 and the trigger 112. The electronic controller 608 may be located on a PCB board (as depicted in the FIG. 6*a*) is operable, i.e., autonomously, or manually when designed, to communicate or control components it may be wirelessly or wired connected to in the assembly 100. To that end, the electronic controller 608 is operably configured to cause the laser emission module 604 to emit the pulsed laser light emission through the emission aperture 606 and the muzzle 108 when the trigger 112 is in the firing position and cease emission of the pulsed laser light emission when the trigger is in the static position. It may effectuate this control or activation through use of one or more trigger sensor(s) or switch(es) 816 operably configured to detect when the trigger 112 has been pulled to a desired position.

With reference to FIG. 6*a* and in one embodiment, the muzzle 108 includes a central muzzle axis 616 spanning through a centroid defined by the muzzle 108. Further, a central emission axis 618 can be seen defined by the pulsed laser light emission operably configured to be emitted from the emission aperture 606 and, when emitted from the emission aperture 606, substantially aligned with and parallel to the central muzzle axis 616. Said another way, when the user pulls the trigger 112 of the assembly 100 a pulsed laser light emission emits from a center of the muzzle 108 or within a 25% of the radius from the center of the muzzle 108. As such, the assembly 100 enables the user to use it as a conventional firearm, as opposed to known lasers which are typically amounted above, below, or not proximal to the muzzle 108.

In one preferred embodiment, the handheld target structure 702 is of a paper-based material configured to generate a visually perceivable indicia 706 when subjected to a laser light with a frequency range of 220-380 nm, i.e., within the UV range. To that end, the laser emission module 604 is operably configured to emit the pulsed laser light emission solely within a frequency range of 220-380 nm from the emission aperture 606, thereby creating a safe firearm for training. The handheld target structure 702 may be coated with a light-sensitive chemical or an emulsion to create the indicia 706 thereon when subjected to the laser light from the module 604. Specifically, the assembly 700 may utilize a UVC (or deep ultraviolet light) laser module 604 that are configured to make markings on the special target paper.

To effectuate simulating use of various types of conventional firearms, the firearm assembly 100, 704 may include a firing type toggle switch 116 projecting through an aperture defined on the body 102. The firing type toggle switch 116 may be located on a side of the body 102 and, along with an on-off switch 204, directly coupled to and/or otherwise operably coupled with the electronic controller 608. Specifically, the firing type toggle switch 116 is operably configured to have a semi-automatic position and an automatic position along a type switch translation path, wherein the semi-automatic position is operably configured to cause a single pulsed laser light emission when the trigger 112 is in the firing position and the automatic position operably configured to cause a frequency of pulsed laser light emissions when the trigger 112 is in the firing position. FIG. 7 depicts and represents an exemplary single pulsed laser light emission and a frequency of pulsed laser light emissions. As the laser light emission(s) are preferably emitted and pulsed in less than one second, or even milliseconds, of time, the pulsed laser light emissions are depicted only for illustrative purposes.

In preferred embodiments, the body 102 defines an internal magazine housing (illustrated with phantom lines and numeral 602) shaped and sized to receive a selectively removable magazine body 118. The size and shape may vary, but it may preferably match the magazine shape and size of the firearm attempting to emulate or simulate with the firearm assembly 100, 704. To that end, the magazine body 118 beneficially has a weight ranging from 12 oz-1 lb12 oz, thereby emulating most conventional magazines or clips and giving a user an experience closely imitating conventional firearm use. In one embodiment, the magazine body 118 is selectively removably coupled to the body 102 and disposed within the internal magazine housing 602. In one embodiment, the magazine body 118 is selectively locked in the body 102 and released and removed from the body 102 using a release switch 120.

Specifically, in one embodiment, one of the plurality of positions along the type switch translation path generates, through the electronic controller 608, a defined limit of the pulsed laser light emission(s). Said another way and in one embodiment, the amount of laser light emissions emitted from the laser emission module 604 may be capped, similar to ammunition in a magazine, whereby the user in unable to fire the assembly 100, 704 unless and until the user uncouples the magazine body 118 is released and recoupled to the body 102. Further, the electronic controller 608 is operably configured to cause the laser emission module 604 to emit the pulsed laser light emission through the emission aperture 606 and the muzzle 108 when the trigger 112 is in the firing position and when the magazine body 118 is selectively removably coupled to the body 102, i.e., the assembly 100, 704 is ready to fire when the user recouples the magazine body 118 to the body 102

In one embodiment, the assembly 100, 704 utilizes a magazine sensor 806 coupled to the body 102 and that is operably configured to detect when the magazine body 118 is selectively removably coupled to the body 102. Further, the magazine release switch 120 may project through an aperture defined on the body 102 and is operably configured to lock and engage with the magazine body 118 and unlock and disengage with the magazine body 118.

Therefore, in one embodiment, the firing type toggle switch 116 is operably configured to have a magazine position along the type switch translation path, wherein the magazine position is operably configured to generate an original limited and diminishable amount of laser light emissions operably configured to be emitted from the laser emission module 604 when the trigger 112 is in the firing position.

To further effectuate the same, the assembly 100, 704 may include a memory 800 coupled to the body 102, that is communicatively coupled to the electronic controller 608, and includes computer-readable instructions resident thereon that are programed to determine the amount of laser light emissions operably configured to be emitted from the laser emission module 604 when the trigger 112 is in the firing position (e.g., one pulsed emission if a semi-automatic firearm). The instructions may also be programmed to cease laser light emissions operably configured to be emitted from the laser emission module 604 when the trigger 112 is in the firing position and when the amount of laser light emissions (e.g., ten single pulsed emissions emulating a magazine with ten ammunition cartridges) has diminished to a numeral value of zero (e.g., ever pulling of the trigger 112 diminishes the original limit of emissions by one). Further, the instructions may also be programmed to reset to the original limited and diminishable amount of laser light emissions operably configured to be emitted from the laser emission module 604 when the trigger 112 is in the firing position when the magazine sensor 806 detects when the magazine body 118 is selectively removably coupled to the body 102.

Figure 2:
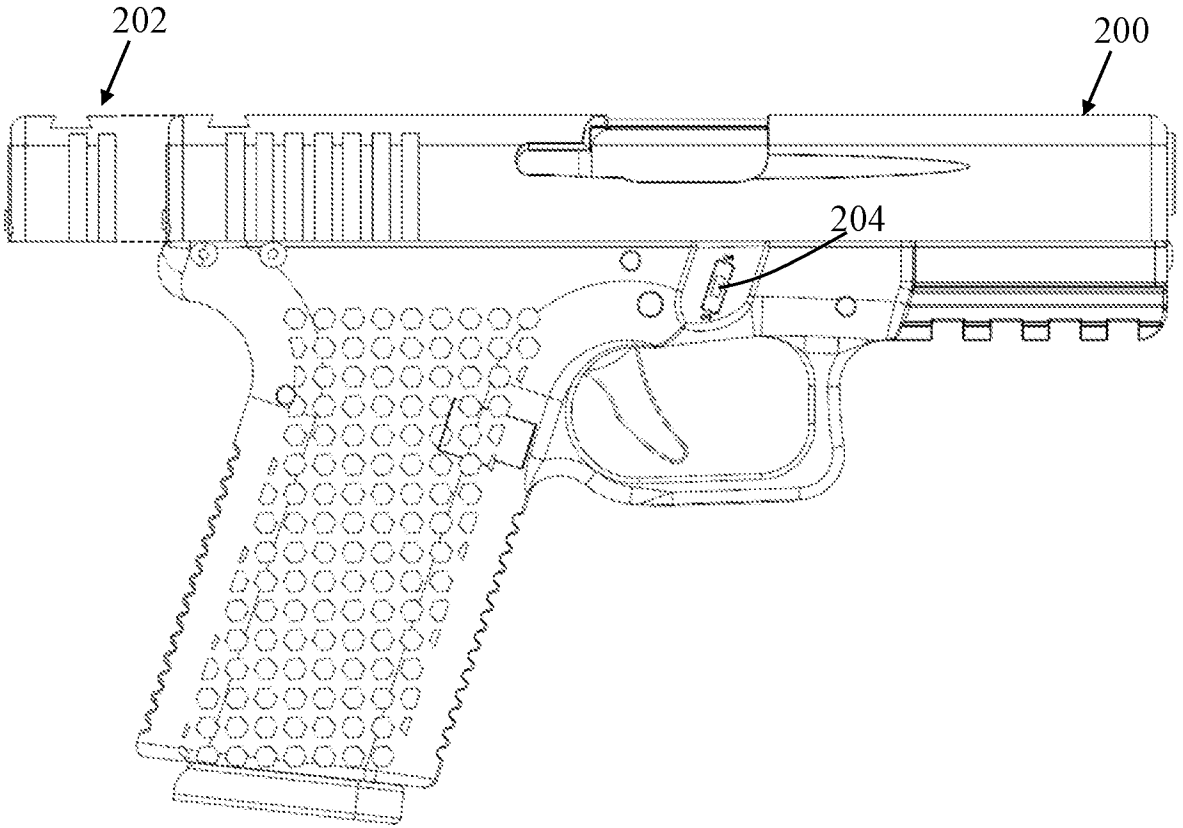
FIG. 2 is an elevational side view of the laser-based firearm assembly in FIG. 1.
Figure 5:
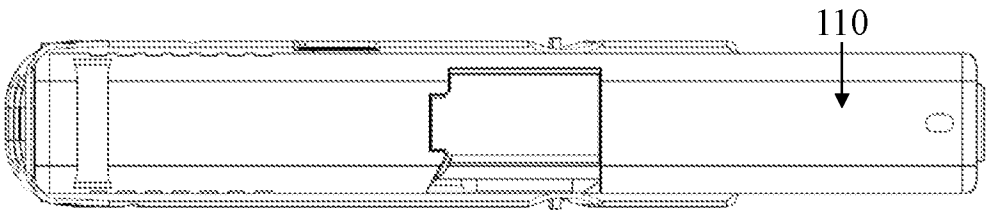
FIG. 5 is a top plan view of the laser-based firearm assembly in FIG. 1.
Figure 4:
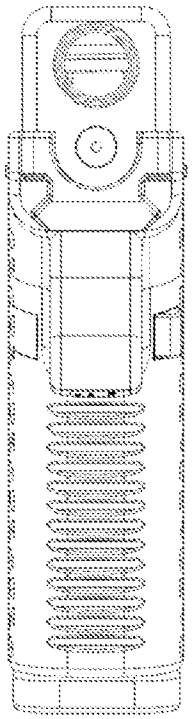
FIG. 4 is an elevational front view of the laser-based firearm assembly in FIG. 1.

Additionally, with reference to FIGS. 1-2 and FIG. 8, the body 102 also includes a slide member 612 translatably coupled (e.g., linearly) to the body 102, defining at least a portion of the barrel portion 106, defining the upper surface 110 of the barrel portion 106, and is operably configured to have a static position 200 and a dynamic position 202 along a slide translation path. Beneficially, a slide sensor 810 may be utilized a 810 operably configured to detect when the slide member 612 is in the dynamic position 202, wherein the memory 800 includes computer-readable instructions resident thereon and programed to prevent the laser emission module 604 from emitting the pulsed laser light emission through the emission aperture 606 and the muzzle 108 when the trigger 112 is in the firing position until the slide member 612 is detected in the dynamic position 202. In preferred embodiments, the detection of the slide member 612 in the dynamic position is only required to emit pulsed laser light emission(s) when the magazine body 118 is removed and then inserted back into the body 102. In some embodiments, the body 102 is operable (i.e., shaped, sized, and configured) to be used with a stock or conventional firearm slide, thereby having the ability for the user to utilize the optic(s), laser(s), or other structure coupled to said stock or conventional firearm slide.

In some embodiments, the body 102 defines an internal magazine housing 602 and a magazine body 118 selectively removably coupled to the body 102 and disposed within the internal magazine housing 602, but there is no button, switch, or programmed ability to modify the firing type, i.e., the firearm assembly 100, 704 is always configured in the semi-automatic configuration. The electronic controller 608 may still generate a defined frequency limit of the pulsed laser light emission based on the type magazine desired to emulate and may be operably configured to cause the laser emission module 604 to emit the pulsed laser light emission through the emission aperture 606 and the muzzle 108 when the trigger 112 is in the firing position and when the magazine body 118 is selectively removably coupled to the body 102. To that end, the electronic controller 608 may be operably configured to generate an original limited and diminishable amount of laser light emissions operably configured to be emitted from the laser emission module 604 when the trigger 112 is in the firing position. Additionally, a non-transitory memory 800 may be coupled to the body 102, is communicatively coupled to the electronic controller 608, and includes computer-readable instructions resident thereon and programed to determine the amount of laser light emissions operably configured to be emitted from the laser emission module 604 when the trigger 112 is in the firing position, cease laser light emissions operably configured to be emitted from the laser emission module 604 when the trigger 112 is in the firing position and when the amount of laser light emissions has diminished to a numeral value of zero, and to reset to the original limited and diminishable amount of laser light emissions operably configured to be emitted from the laser emission module 604 when the trigger 112 is in the firing position and when the magazine sensor 806 detects when the magazine body 118 is selectively removably coupled to the body 102.

In another embodiment of the present invention, the original limited and diminishable amount of laser light emissions may be reset using a switch on the body 102, e.g., switch 116. The switches and electrical components are also depicted in the fragmentary exploded view of FIG. 6*a*.

In some embodiments of the present invention, a gyroscope 808 is communicatively coupled to a memory 800 coupled to the body 102, wherein the gyroscope 808 is operably configured to detect an orientation or rotation of the body 102, alignment of the firearm and store the orientation, alignment, including any degree of rotation, of the body 102 on the memory when the trigger 112 is in the firing position. In additional embodiments, an accelerometer may be utilized and that is communicatively coupled to a memory 800, wherein the accelerometer is operably configured to detect acceleration of the firearm assembly 100, 704 when utilized by the user and store said detected acceleration along a period of time on the memory. Both the gyroscope 808 and/or accelerometer may be coupled to the PCB board/controller 606. Beneficially, the gyroscope 808 may detect what hand a user "draws" from and how the gun is oriented when trigger 112 is pulled. In some embodiments, this data may be communicated wirelessly or through a wired connection and/or networking interface 812 to a software application 814 to be recalled for future reference and/or for sharing over a network of users of the software. The network interface may be embodied in a network interface card, network adapter, LAN adapter or physical network interface, or other similar structure that is a computer hardware component operably configured to connect a computing device to a computer network.

To that end, the software application 814 may resident on an electronic device of a user and the firearm assembly 100, 704 may be communicatively coupled to the electronic device of the user over a network, which includes connection(s), which are the medium used to provide communications links between various devices and computing device connected together. The connections may be wired or wireless connections. A few exemplary wired connections are cable, phone line, and fiber optic. Exemplary wireless connections include radio frequency (RF) and infrared radiation (IR) transmission. Many other wired and wireless connections are known in the art and can be used with the present invention. The network may also include the Internet, which represents a worldwide collection of networks and gateways that use the TCP/IP suite of protocols to communicate with one another. At the heart of the Internet is a backbone of high-speed data communication lines between major nodes or host computers, consisting of thousands of commercial, government, educational and other computer systems that route data and messages. Of course, network also may be implemented as a number of different types of networks, such as for example, an Intranet, a local area network (LAN), a wide area network (WAN), a cellular network.

The firearm assembly 100, 704 may also include a reset button 124, preferably beneath the laser module 604, for resetting any programmed timing of firing the laser module 604 and/or for changing between settings the firearm assembly 100, 704. In one embodiment, the firearm has the ability to capture and store the timing between each time the trigger is pulled, thereby In one embodiment of the present invention, the power wattage may range from 2-20 W and the targeting paper may be chemical pulp fibred, board, copying paper and may leave indicia when exposed to a pulsed laser emission, e.g., UVC or CO2 laser. In one embodiment, the user may utilize a camera, preferably forming part of the user's electronic computing device and having the above-referenced software application 814 resident thereon, aimed at the outer surface 712 of the target structure. The software application 814 may include instructions configured to work in conjunction with the camera on the portable computing device. Specifically, the camera may detect the indicia when aimed at the outer surface 712 of the target structure 702 and record, where on the target structure said is indicia located, thereby recording the results on the user's electronic computing device or on a remote server for review by the user. The software application may also measure the time period between when each indicia is made, thereby keeping a record of the firing timing. As such, the location of the indicia relative to the target, timing between firing, and other firing information (collectively, "Firing Information") captured from the camera and/or the sensors from the firearm may be stored on a user account for personal recall by the user and/or for comparison with other users communicatively coupled together over a network. To that end, the Firming Information may be stored on a remote administrative server where it may be accessed and/or shared with other users for competitive reasons and/or for improvement. In further embodiments, the camera will be operable to capture video of the user's shots and, using known technology to decipher markings on a video, ascertain the score on the targets from the user's shots.

Figure 9:
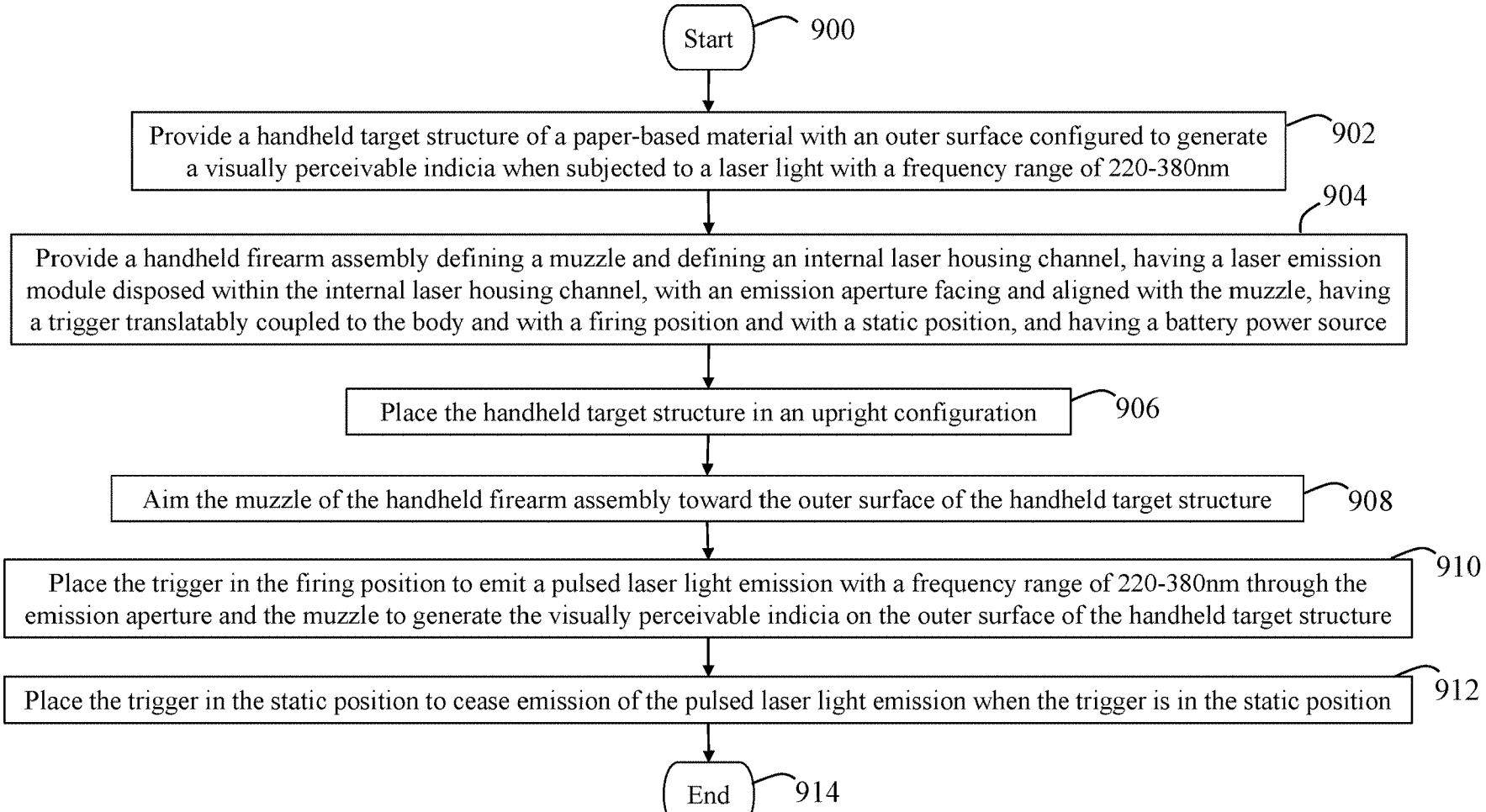
FIG. 9 is a process-flow diagram depicting a method of training with a laser-based firearm and target in accordance with one embodiment of the present invention.

The above-described assembly 700 can also be utilized with an inventive method of target training with a laser-based firearm and is described in conjunction with the process flow chart of FIG. 9. Although FIG. 9 shows a specific order of executing the process steps, the order of executing the steps may be changed relative to the order shown in certain embodiments. Also, two or more blocks shown in succession may be executed concurrently or with partial concurrence in some embodiments. Certain steps may also be omitted in FIG. 9 for the sake of brevity. In some embodiments, some or all of the process steps included in FIG. 9 can be combined into a single process.

With reference to FIG. 1, FIGS. 6*a-b*, FIG. 7, and FIG. 9, the method may begin at step 900 and immediately proceed to the step 902 of providing a handheld target structure 702 of a paper-based material with an outer surface 712 configured to generate a visually perceivable indicia 706 when subjected to a laser light with a frequency range of 220-380 nm. Next, step 904 may include providing a handheld firearm assembly 100, 704 having a body 102 with a grip portion 104, with a barrel portion 106 defining a muzzle 108, and defining an internal laser housing channel 600, having a laser emission module 604 disposed within the internal laser housing channel 600, with an emission aperture 606 facing and aligned with the muzzle 108, having a trigger 112 translatably coupled to the body 102 and with a firing position along a trigger translation path 114 and with a static position along the trigger translation 114, and having a battery power source 610 electrically coupled to the laser emission module 604 and coupled to the body 102.

Thereafter, the method includes the step 906 of placing the handheld target structure 702 in an upright configuration and then step 908 of aiming the muzzle 108 of the handheld firearm assembly 100, 704 toward the outer surface of the handheld target structure 702. Thereafter, step 910 may include placing the trigger 112 in the firing position to emit a pulsed laser light emission with a frequency range of 220-380 nm through the emission aperture 606 and the muzzle 108 to generate the visually perceivable indicia 706 on the outer surface 712 of the handheld target structure 702. Next, step 912 includes placing the trigger 112 in the static position to cease emission of the pulsed laser light emission when the trigger 112 is in the static position. The process may terminate at step 916.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features.

What is claimed is:

1. A laser-based firearm and target training assembly comprising:

a handheld target structure of a material configured to generate a visually perceivable indicia when subjected to a laser light with a frequency range of 220-1060 nm; and a handheld firearm assembly having:

a body with a grip portion and with a barrel portion defining a muzzle, defining an internal laser housing channel, defining an internal magazine housing, and including an upper surface;

a laser emission module disposed within the internal laser housing channel, with an emission aperture facing and aligned with the muzzle, and operably configured to emit a pulsed laser light emission of a frequency range of 220-1060 nm from the emission aperture;

a trigger translatably coupled to the body and having a firing position along a trigger translation path and a static position along the trigger translation;

a battery power source electrically coupled to the laser emission module and coupled to the body;

an electronic controller electrically coupled to the battery power source, operably coupled to the laser emission module and the trigger, and operably configured to cause the laser emission module to emit the pulsed laser light emission through the emission aperture and the muzzle when the trigger is in the firing position and cease emission of the pulsed laser light emission when the trigger is in the static position; and a magazine body selectively removably coupled to the body and disposed within the internal magazine housing, the electronic controller generating a defined frequency limit of the pulsed laser light emission and operably configured to cause the laser emission module to emit the pulsed laser light emission through the emission aperture and the muzzle when the trigger is in the firing position and when the magazine body is selectively removably coupled to the body.

2. The laser-based firearm and target training assembly according to claim 1, further comprising:

the handheld target structure of a paper-based material configured to generate a visually perceivable indicia when subjected to a laser light with a frequency range of 220-380 nm; and the laser emission module is operably configured to emit the pulsed laser light emission of a frequency range of 220-380 nm from the emission aperture.

3. The laser-based firearm and target training assembly according to claim 2, further comprising:

a firing type toggle switch projecting through an aperture defined on the body operably coupled with the electronic controller, the firing type toggle switch operably configured to include a semi-automatic position and an automatic position along a type switch translation path, the semi-automatic position operably configured to cause a single pulsed laser light emission when the trigger is in the firing position and the automatic position operably configured to cause a frequency of pulsed laser light emissions when the trigger is in the firing position.

4. The laser-based firearm and target training assembly according to claim 3, wherein one of the plurality of positions along the type switch translation path generating, through the electronic controller, the defined frequency limit of the pulsed laser light emission.

5. The laser-based firearm and target training assembly according to claim 4, further comprising:

a magazine sensor coupled to the body and operably configured to detect when the magazine body is selectively removably coupled to the body; and a magazine release switch projecting through an aperture defined on the body and operably configured to lock and engage with the magazine body and unlock and disengage with the magazine body.

6. The laser-based firearm and target training assembly according to claim 5, further comprising:

the firing type toggle switch operably configured to have a magazine position along the type switch translation path, the magazine position operably configured to generate an original limited and diminishable amount of laser light emissions operably configured to be emitted from the laser emission module when the trigger is in the firing position; and a memory coupled to the body, communicatively coupled to the electronic controller, and having computer-readable instructions resident thereon and programed to:

determine the amount of laser light emissions operably configured to be emitted from the laser emission module when the trigger is in the firing position;

cease laser light emissions operably configured to be emitted from the laser emission module when the trigger is in the firing position and when the amount of laser light emissions has diminished to a numeral value of zero; and reset to the original limited and diminishable amount of laser light emissions operably configured to be emitted from the laser emission module when the trigger is in the firing position when the magazine sensor detects when the magazine body is selectively removably coupled to the body.

7. The laser-based firearm and target training assembly according to claim 6, wherein:

the magazine body has a weight ranging from 12 oz-1 lb 12 oz.

8. The laser-based firearm and target training assembly according to claim 7, wherein the body further comprises:

a slide member translatably coupled to the body, defining at least a portion of the barrel portion, defining the upper surface of the barrel portion, and operably configured to have a static position and a dynamic position along a slide translation path; and a slide sensor operably configured to detect when the slide member is in the dynamic position, wherein the memory includes computer-readable instructions resident thereon and programed to prevent the laser emission module from emitting the pulsed laser light emission through the emission aperture and the muzzle when the trigger is in the firing position until the slide member is detected in the dynamic position.

9. The laser-based firearm and target training assembly according to claim 1, wherein the body further comprises:

a bottom surface opposing the upper surface of the barrel portion, a front sight coupled to the upper surface of the barrel portion and disposed proximal to the muzzle, and a rear sight coupled to the upper surface of the barrel portion and aligned with the front sight, wherein the laser emission module is interposed between the bottom surface and the upper surface.

10. The laser-based firearm and target training assembly according to claim 1, further comprising:

a magazine sensor coupled to the body and operably configured to detect when the magazine body is selectively removably coupled to the body; and a magazine release switch projecting through an aperture defined on the body and operably configured to lock and engage with the magazine body and unlock and disengage with the magazine body.

11. The laser-based firearm and target training assembly according to claim 10, wherein electronic controller is operably configured to generate an original limited and diminishable amount of laser light emissions operably configured to be emitted from the laser emission module when the trigger is in the firing position, further comprising:

a memory coupled to the body, communicatively coupled to the electronic controller, and having computer-readable instructions resident thereon and programed to:

determine the amount of laser light emissions operably configured to be emitted from the laser emission module when the trigger is in the firing position;

cease laser light emissions operably configured to be emitted from the laser emission module when the trigger is in the firing position and when the amount of laser light emissions has diminished to a numeral value of zero; and reset to the original limited and diminishable amount of laser light emissions operably configured to be emitted from the laser emission module when the trigger is in the firing position and when the magazine sensor detects when the magazine body is selectively removably coupled to the body.

12. The laser-based firearm and target training assembly according to claim 1, wherein:

the internal laser housing is of a shape corresponding to a shape of the laser emission module, the body having two opposing internal walls defining a length separating each other and substantially equal to a length separating two opposing ends of the laser emission module, the emission aperture of the laser emission module disposed proximal to the muzzle.

13. The laser-based firearm and target training assembly according to claim 1, further comprising:

a central muzzle axis spanning through a centroid defined by the muzzle; and a central emission axis defined by the pulsed laser light emission operably configured to be emitted from the emission aperture and, when emitted from the emission aperture, substantially aligned with and parallel to the central muzzle axis.

14. The laser-based firearm and target training assembly according to claim 1, further comprising:

a gyroscope communicatively coupled to a memory coupled to the body, wherein the gyroscope is operably configured to detect an orientation of the body and store the orientation of the body on the memory when the trigger is in the firing position.

15. A method of target training with a laser-based firearm, comprising the steps of:

providing a handheld target structure of a paper-based material with an outer surface configured to generate a visually perceivable indicia when subjected to a laser light with a frequency range of 220-380 nm;

providing a handheld firearm assembly having a body with a grip portion, with a barrel portion defining a muzzle, and defining an internal laser housing channel, having a laser emission module disposed within the internal laser housing channel, with an emission aperture facing and aligned with the muzzle, having a trigger translatably coupled to the body and with a firing position along a trigger translation path and with a static position along the trigger translation, and having a battery power source electrically coupled to the laser emission module and coupled to the body;

providing the body of the handheld firearm assembly that defines an internal magazine housing and a magazine body selectively removably coupled to the body and disposed within the internal magazine housing;

placing the handheld target structure in an upright configuration;

aiming the muzzle of the handheld firearm assembly toward the outer surface of the handheld target structure;

placing the trigger in the firing position to emit a pulsed laser light emission with a frequency range of 220-380 nm through the emission aperture and the muzzle to generate the visually perceivable indicia on the outer surface of the handheld target structure;

placing the trigger in the static position to cease emission of the pulsed laser light emission when the trigger is in the static position; and defining, with the electronic controller, a defined frequency limit of the pulsed laser light emission and operably configured to cause the laser emission module to emit the pulsed laser light emission through the emission aperture and the muzzle when placing the trigger in the firing position and when the magazine body is selectively removably coupled to the body.

16. The method of target training with the laser-based firearm according to claim 15, further comprising:

providing the handheld firearm assembly with an electronic controller electrically coupled to the battery power source, and operably coupled to the laser emission module and the trigger; and causing the laser emission module to emit the pulsed laser light emission through the emission aperture and the muzzle when placing the trigger in the firing position and causing the laser emission module to cease emission of the pulsed laser light emission when placing the trigger in the static position.

17. The method of target training with the laser-based firearm according to claim 15, further comprising:

providing the handheld firearm assembly with the electronic controller that is operably configured to generate an original limited and diminishable amount of laser light emissions operably configured to be emitted from the laser emission module when placing the trigger in the firing position;

determining the amount of laser light emissions operably configured to be emitted from the laser emission module when placing the trigger in the firing position;

ceasing laser light emissions operably configured to be emitted from the laser emission module when placing the trigger in the firing position and when the amount of laser light emissions has diminished to a numeral value of zero; and resetting to the original limited and diminishable amount of laser light emissions operably configured to be emitted from the laser emission module when placing the trigger in the firing position and when a magazine sensor detects when the magazine body is selectively removably coupled to the body.

* * * * *